US006465998B2

(12) United States Patent
Sirito-Olivier

(10) Patent No.: US 6,465,998 B2
(45) Date of Patent: Oct. 15, 2002

(54) CURRENT SOURCE WITH LOW SUPPLY VOLTAGE AND WITH LOW VOLTAGE SENSITIVITY

(75) Inventor: Philippe Sirito-Olivier, St. Egreve (FR)

(73) Assignee: STMicroelectronics S.A., Montrouge (FR)

( * ) Notice: Subject to any disclaimer, the term of this patent is extended or adjusted under 35 U.S.C. 154(b) by 0 days.

(21) Appl. No.: 09/864,917

(22) Filed: May 24, 2001

(65) Prior Publication Data

US 2002/0014883 A1 Feb. 7, 2002

(30) Foreign Application Priority Data

May 30, 2000 (FR) ..... 00 06913

(51) Int. Cl.[7] ..... G05F 3/16; G05F 1/10
(52) U.S. Cl. ..... 323/315; 327/538
(58) Field of Search ..... 323/312, 313, 323/314, 315, 316, 907; 327/538, 530, 543, 541; 363/59, 60

(56) References Cited

U.S. PATENT DOCUMENTS

| | | | | |
|---|---|---|---|---|
| 4,078,199 A | | 3/1978 | Chapron et al. | 323/1 |
| 4,435,678 A | * | 3/1984 | Joseph et al. | 323/273 |
| 4,495,425 A | * | 1/1985 | McKenzie | 307/297 |
| 5,001,414 A | * | 3/1991 | Brambilla et al. | 323/313 |
| 5,334,929 A | * | 8/1994 | Schade, Jr. | 323/315 |
| 5,689,460 A | * | 11/1997 | Ooishi | 365/189.07 |
| 5,859,528 A | * | 1/1999 | Honama | 323/315 |
| 5,892,388 A | * | 4/1999 | Chiu | 327/543 |
| 5,910,749 A | | 6/1999 | Kimura | 327/541 |
| 5,918,221 A | * | 6/1999 | Manaresi et al. | 706/9 |
| 6,160,432 A | * | 12/2000 | Rhee et al. | 327/157 |

FOREIGN PATENT DOCUMENTS

| | | | |
|---|---|---|---|
| EP | 0684537 | 11/1995 | G05F/3/26 |
| FR | 2680888 | 3/1993 | G05F/3/26 |

OTHER PUBLICATIONS

Deval et al., *1–Volt Ratiometric Temperature Stable Current Reference,* IEEE International Symposium on Circuits and Systems, US, New York, NY IEEE, Jun. 9, 1997, pp. 1984–1987; XP000802968.

Henn, *Stromsteuerugen im Vormarsch Teil 1*, Radio Fernsehen Elektronik, De, Veb, Verlag Technik. Berlin, vol. 43, No. 5, May 1, 1994, pp. 43–45, XP000478290.

Grey et al., *Analysis and Design of Analog Integrated Circuits*, Third Edition, 1993, pp. 279, 345–346. No Date Available.

* cited by examiner

*Primary Examiner*—Rajnikant B. Patel
(74) *Attorney, Agent, or Firm*—Lisa K. Jorgenson; Allen, Dyer, Doppelt, Milbrath & Gilchrist, P.A.

(57) ABSTRACT

A current source includes a master branch including a branch current fixing resistor, at least one slave branch, and a current mirror including a mirror transistor in each of the master and slave branches, respectively, to couple the branches. The current source may additionally include at least one of a first circuit for injecting in the current fixing resistor a current proportional to the master branch current and a second circuit for injecting in a degeneration resistor of the mirror transistor of the slave branch a current proportional to a current of the slave branch. The invention is particularly applicable to the manufacture of integrated circuits.

30 Claims, 2 Drawing Sheets

CURRENT SOURCE WITH LOW SUPPLY VOLTAGE AND WITH LOW VOLTAGE SENSITIVITY

FIELD OF THE INVENTION

The present invention relates to the field of electronic circuits, and, more particularly, to a current source which may be supplied by a very low supply voltage (e.g., about 1.1 Volt) and which has reduced sensitivity to variations in supply voltage.

BACKGROUND OF THE INVENTION

Current sources are found in most integrated circuits. They are used for the biasing the various constituent parts of circuits. Integrated circuits are generally designed to be supplied by a wide range of supply voltages. By way of example, certain operational amplifiers may be supplied by a voltage between 2.7 Volts and 12 Volts. For such integrated circuits, it is important for their current sources to deliver currents that have little variance with respect to the supply voltage so that the operation of the integrated circuit is not influenced by the available supply voltage.

Furthermore, it is desirable for current sources to operate from a low supply voltage to reduce electrical consumption and to make the best use of the available power. This is particularly the case with devices powered by a battery, for example. The invention finds applications generally in the manufacture of electronic circuits, particularly integrated circuits, such as circuits intended for portable equipment.

One current source according to the prior art exhibiting substantial independence from the voltage supply includes a voltage generator delivering a regulated voltage and supplying a conventional current source at a constant voltage. Such generators, commonly referred to as bandgap generators, are described, for example, in Analysis and Design of ANALOG INTEGRATED CIRCUITS by Paul R. Gray, Robert G. Meyer, Third Edition, Ch. 4, A 4.3.2, pp. 345–346. These generators deliver a constant voltage of about 1.2 Volts and, therefore, require a supply voltage above this value. The minimum supply voltage required by bandgap generators is at least 1.3 to 1.5 Volts.

Another known current source may be seen in FIG. 1. This is a so-called crossed source. The crossed source is constructed around four source transistors 10, 12, and 25, 26, connected in a master branch 14 and a slave branch 16, respectively. A current fixing resistor 18 of a value R is connected in series with the first transistor 10 of the master branch. The base of each of the source transistors 10 and 12 of a given branch is connected respectively to the source transistor collector of the other branch. A current mirror 20 allows the current I circulating in the master branch to be copied to the slave branch. The current mirror 20 is constructed around two transistors 21 and 22 connected in the master branch and the slave branch, respectively. An output current for a load can be copied in an output branch (not shown) either from the master branch or from the slave branch.

The current I circulating in the master branch 14 is equal to $$I = \frac{\Delta V_{BE}}{R}$$

where $\Delta V_{BE}$ is such that $\Delta V_{BE}=(V_{BE26}+V_{BE12})-(V_{BE25}+V_{BE10})$. In this expression, $V_{BE26}$, $V_{BE12}$, $V_{BE25}$, and $V_{BE10}$ represent the base-emitter voltages of the transistors 26, 12, 25 and 10, respectively.

One peculiarity of the current source of FIG. 1 is that the current of the branches 14, 16 evolves as a decreasing function of the supply voltage applied between the supply terminals 24, 26 of the source. In other words, the source current tends to increase when the supply voltage falls. This characteristic is particularly advantageous when the current source is combined with other elements whose outputs evolve positively, i.e., as a growing function with the supply voltage.

To allow the operation of a current source such as that shown in FIG. 1, it is necessary to have available between the supply terminals 24 and 26 a voltage $V_{comin}$ equal to at least twice the base-emitter voltage $V_{be}$ of a bipolar transistor (source transistor and cascode stage transistor). To this the collector-emitter saturation voltage $V_{cesat}$ of a third transistor (current mirror) is added. In other words, $V_{comin}=2V_{be}+V_{cesat}$. For typical bipolar silicon transistors such as those represented in FIG. 1, the minimum supply voltage is about 1.8 Volts. This voltage is comparable with that required by the source using the bandgap type generator.

A third example of a current source according to the prior art is shown in FIG. 2. This is a simple cascoded source. To simplify the description, different elements of this current source, comparable with those of the current source in FIG. 1, are identified with the same numerical references. Reference may be made, for these elements, to the above description. Unlike the current source of FIG. 1, it may be seen that the bases of the source transistors 10 and 12 are connected to each other. The transistors 25 and 26 which are connected to the source transistors form a cascode stage. An output branch 30 includes a load 32 to be supplied by the output current and a copy transistor 34 controlled by the common bases of the transistors of the mirror stage 20. The use of a cascode stage 25, 26 makes it possible to obtain a high output impedance for the source and therefore a relatively low variation in output current.

By analogy with the current source of FIG. 1, it may be seen that the minimum supply voltage is still such that $V_{comin}=2V_{be}+V_{cesat?}$ 1.8 Volts. With the current source of FIG. 2, in which an emitter surface ratio of source transistors is equal to 10, and in which the current fixing resistor has a value of 5 k ω, a master branch current sensitivity as low as 1.6% per volt can be obtained (the current sensitivity in the slave branch is then about 5.2% per volt).

A fourth prior art current source may be seen in FIG. 3. This current source is commonly referred to as a emitter degeneration source and is further described, for example, in Analysis and Design of ANALOG INTEGRATED CIRCUITS by Paul R. Gray, Robert G. Meyer, Third Edition, Ch. 4, A 4.2.1, p. 276. The current source of FIG. 3 still includes two branches 14 and 16 coupled by a current mirror 20. The master branch 14 includes a first source transistor 10 in series with a current fixing resistor 18. The slave branch includes a second source transistor 12 connected to the first transistor by its base.

Unlike the current sources described in the previous figures, the cascode stage has been eliminated from the current source of that of FIG. 3. The source transistors are in fact connected directly to those of the current mirror 20.

On the other hand, the emitters of the bipolar transistors 21, 22 used to form the current mirror 20 are connected to the upper supply terminal 24 by so-called degeneration resistors 41, 42, respectively. The values of these resistors will be referred to as $R_3$ and $R_4$, respectively, hereafter. The minimum supply voltage now becomes, for example, $V_{comin}=V_{be12}+V_{cesat22}+R_4I_2$. In this expression, $V_{be12}$ is the base emitter voltage of the source transistor of the slave branch 14, $V_{cesat22}$ is the collector-emitter saturation voltage of the mirror transistor 22, and $I_2$ is the current circulating in the slave branch 16. The current circulating in the master branch is $I_1$.

For a current source comparable with that of FIG. 3, the choice of low degeneration resistor values makes it possible to reduce the minimum supply voltage required for the operation of the source. On the other hand, these low values of the degeneration resistors increase the sensitivity of the output current to the supply voltage. This aspect will emerge more clearly in the following description.

SUMMARY OF THE INVENTION

An object of the invention is to provide a current source supplying an output current that is substantially independent of the supply voltage.

Another object of the invention is to provide such a current source that may be powered at a low supply voltage.

These and other objects, features, and advantages according to the invention are provided by a current source including a master branch including a branch current fixing resistor, at least one slave branch, and a current mirror including a mirror transistor in each of the master and slave branches, respectively, to couple the branches. The current source may additionally include at least one of a first circuit or means for injecting in the current fixing resistor a current proportional to the master branch current and a second circuit or means for injecting in a mirror transistor degeneration resistor of the slave branch a current proportional to a current of the slave branch. The injection means make it possible to reduce at the same time the minimum value of the supply voltage and the sensitivity of the source current to this voltage.

An output current can be copied in an output branch by a transistor controlled either by the common bases of so-called source transistors or by the common bases of the mirror transistors. As used herein, "source transistors" are those transistors intended to set the source current value. They may be in series with the mirror transistors, for example.

More specifically, the first current injection means may include a first injection transistor connected to the current fixing resistor and forming a current mirror with the mirror transistor of the master branch. The current fixing resistor thus passes not only the master branch current but also the current supplied to it by the first injection transistor. The injection transistor is preferably controlled by the mirror transistor to form with it a weighted current mirror. More precisely, the weighted current mirror may be obtained by combining a degeneration resistor with the mirror transistor of the master branch.

Further, the weighted current mirror may be obtained by using a first injection transistor having an emitter surface that is greater than that of the mirror transistor of the master branch. Also, the second current injection means may include a second injection transistor connected to the degeneration resistor and forming a current mirror with a source transistor connected in series with the mirror transistor of the slave branch. If both the first and second current injection means are used, the master branch and the slave branch may each include a degeneration resistor, for example. The second injection transistor may also be chosen to have an emitter surface greater than that of the branch source transistor to form therewith a weighted mirror.

BRIEF DESCRIPTION OF THE DRAWINGS

Other characteristics and advantages of the present invention will become apparent from the following description, with reference to the appended drawings, given by way of non-limitative example, in which.

DETAILED DESCRIPTION OF THE PREFERRED EMBODIMENTS

Figure 4:
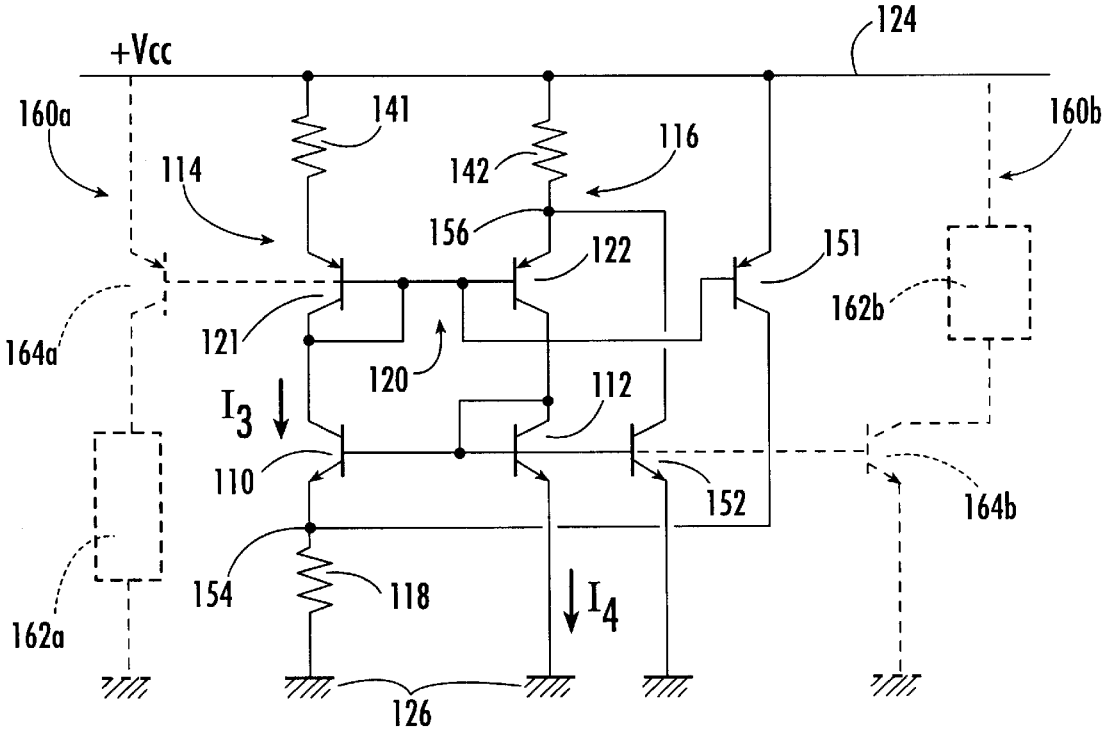
FIG. 4 is schematic circuit diagram of a current source according to the invention.

Turning now to FIG. 4, a current source according to the invention includes essentially two branches 114, 116 combined by a current mirror 120. The source branches 114, 116 are connected between a first supply terminal 124 with a positive potential ($V_{cc}$) and a second supply terminal 126 connected to ground, for example.

The first branch 114 is a master branch. It includes, in order from the first supply terminal, a first degeneration resistor 141 of a value $R_2$, a first mirror transistor 121, a first source transistor 110, and a current fixing resistor 118. The first mirror transistor (shown as a PNP type) is connected to the degeneration resistor 141 by its emitter and is connected by its collector to the collector of the source transistor 110. The collector of the mirror transistor is also connected to the base of this transistor. The source transistor 110 of the master branch (shown as an NPN type) is connected to the current fixing resistor by its emitter.

The second branch 116 of the current source is a slave branch. It includes, in order from the first supply terminal, a second degeneration resistor 142 of a value R3, a second PNP mirror transistor 122 connected by its emitter to the degeneration resistor 142, a second source transistor 112 (NPN) connected by its collector to that of the mirror transistor and to the ground terminal by its emitter. The collector of the second source transistor is connected to its base and to the base of the source transistor 110 of the master branch. In the same way, the bases of the mirror transistors of the two branches are connected to each other.

A first current injection transistor 151 (PNP) is connected by its emitter to the first supply terminal 124 and by its collector to a node 154 located between the emitter of the first source transistor and the current fixing resistor. The base of the first current injection transistor 151 is connected to the bases of the mirror transistors to be controlled by the mirror transistor of the master branch 114.

A second current injection transistor 152 of the NPN type is connected by its collector to a node 156 located between the degeneration resistor 142 of the slave branch 116 and the emitter of the mirror transistor 122 of this same branch. The emitter of the second current injection transistor is connected to the ground terminal 126. Operation of the two current injection transistors 151, 152 is independent. However, each injection transistor contributes to the constancy of the current supplied by the source.

The first current injection transistor 151 forms a weighted current mirror with the mirror transistor 121 of the master branch. The weighted character of the mirror stems from the degeneration resistor 141. Indeed, we may write $V_{be151}=V_{be121}+R_2I_3$, where $V_{be121}$, $V_{be151}$ and $I_3$ represent respectively the base-emitter voltage of the mirror transistor of the master branch, the base-emitter voltage of the first current injection transistor, and the current circulating in the master branch. In other words, the base-emitter voltage of the current injection transistor is greater than that of the mirror transistor of the master branch. The current injection transistor therefore makes it possible to inject in the current fixing resistor 118 a current greater than that of the current that it receives from the master branch.

As the supply voltage Vcc applied between the supply terminals 124 and 126 tends to increase, the current $I_3$ circulating in the master branch 114 also tends to increase by the Early effect on the source transistor 110 of the master branch. As the current of the master branch is copied in the current fixing resistor 118 by the first current injection transistor 151, the voltage at the terminals of this resistor tends also to increase.

Furthermore, as the current in the master branch is also copied in the slave branch by the current mirror 120 formed by the mirror transistors 121, 122, an increase in the current $I_3$ of the master branch entails an increase in the current $I_4$ of the slave branch. This results from the mirror effect, to which is added the Early effect of the mirror transistor 122 of the slave branch. The current $I_4$ therefore increases more rapidly. Also, when the current $I_4$ of the slave branch tends to increase, the same is true with the base-emitter voltage of the second source transistor 112.

The current injection in the current fixing resistor makes it is possible to obtain a variation in the voltage at the terminals of this resistor. This variation is greater than that in the base-emitter voltage of the source transistor 112 of the slave branch 116. Further, when the voltage at the terminals of the current fixing resistor 118 increases more than the base voltage of the source transistor 112 of the slave branch 116, the current $I_3$ circulating in the master branch tends to decrease. This is because the base-emitter voltage of the source transistor 110 of the master branch tends to decrease. This phenomenon compensates for the tendency to increase of the same current in response to an increase in the supply voltage. Additionally, the current of the master branch, just like that of the slave branch, remains substantially stable and independent of variations in the supply voltage.

The second current injection transistor 152 forms a current mirror with the source transistor 112 of the slave branch 116. This current mirror makes it possible to copy in the degeneration resistor 142 of the slave branch a current proportional to the current $I_4$ circulating in this branch. In other words, the degeneration resistor 142 passes not only the current of the slave branch, as does the source transistor, but also the current of the second injection transistor.

As the supply voltage Vcc applied between the supply terminals 124 and 126 tends to increase, the same is true with the currents $I_3$ and $I_4$ circulating in the master and slave branches. This point has been discussed above (i.e., the Early effect on transistors 110 (source transistor) and 122 (mirror)). As the current of the slave branch increases, the current delivered by the current injection transistor 152 also increases. The voltage at the terminals of the second degeneration resistor, which passes the sum of these currents, tends therefore a priori to increase with the supply voltage. However, the voltage at the terminals of the second degeneration resistor 142 (slave branch) tends to increase more than the voltage at the terminals of the first degeneration resistor 141 (master branch). This is due to the fact that the current supplied by the second current injection transistor is injected only in the second degeneration resistor and not in the first.

As a result, the base voltage of the mirror transistor 122 of the slave branch 116 tends to fall and entails a drop in the current $I_4$ of the slave branch, and therefore of the master branch. This drop therefore compensates for the tendency of the same current to increase that is caused by the increase in the supply voltage. In this case again, a variation in the supply voltage leaves the current of the current source approximately unchanged.

To supply an electrical load from the current source, it is possible to copy the current from one of the branches 114, 116 in an output branch. Although not being directly part of the current source, FIG. 4 shows, in a dashed line, such output branches. In these branches 160*a* and 160*b*, the electrical loads are identified by the reference 162*a* and 162*b* and copy transistors, combined with the loads, are identified by the references 164*a* and 164*b*. The transistor 164*a* of the first output branch may be of the PNP type and is connected by its emitter to the first supply terminal 124. Its collector is connected to the electrical load and its base is connected to the base of the mirror transistor 121 of the master branch 114. The current supplied to the electrical load is therefore proportional to the current $I_3$ circulating in the master branch.

The transistor 164*b* of the second output branch 160*b* may be of the NPN type and is connected to the ground terminal by its emitter. Its collector is connected to the first supply terminal by the electrical load. Also, its base is connected to that of the source transistor of the slave branch to be controlled thereby.

Table 1 below makes it possible to compare the behavior of the prior art current source of FIG. 3 and the current source according to the invention (FIG. 4). For different characteristics of the sources, the table shows the following values: the currents $I_2$, $I_4$ circulating in the slave branch for a supply voltage of 2.7 Volts; the current variation of the slave branch in percent per volt; the current variation of the master branch in percent per volt; the total current passing through the source branches; and the minimum supply voltage necessary for the operation of the source.

The columns of Table 1 respectively show the following cases. Case A1 represents the current source of FIG. 3 with $R_2=R_3=0$ and $R_1=5.5$ K ω. Case A2 represents the current source of FIG. 3 with $R_2=R_3=1.4$ K ω and $R_1=5.5$ K ω. Case A3 represents the current source of FIG. 3 with $R_2=R_3=50$ K ω and $R_1=5.5$ K ω. Case I1 represents the current source of FIG. 4 with $R_2=R_3=1.4$ KW, with transistor 151, and without transistor 152. Case I2 represents the current source of FIG. 4 with $R_2=R_3=1.4$ K ω, without transistor 151, and with transistor 152. Case I3 represents the current source of FIG. 4 with $R_2=R_3=1.4$ K ω and with transistors 151 and 152. The current variations are shown in percent per volt of $V_{cc}$.

TABLE 1

| Case | A1 | A2 | A3 | I1 | I2 | I3 |
|---|---|---|---|---|---|---|
| $I_2$ | 10 μA | 10 μA | 10 μA | | | |
| $I_4$ | | | | 10 μA | 10 μA | 10 μA |
| $\Delta I_2$ | 5.8%/V | 3.8%/V | 1.1%/V | | | |

TABLE 1-continued

| Case | A1 | A2 | A3 | I1 | I2 | I3 |
|---|---|---|---|---|---|---|
| $\Delta I_4$ | | | | 1.9%/V | 2.3%/V | 0.74%/V |
| $\Delta I_1$ | 2.2%/V | 1.7%/V | 0.9%/V | | | |
| $\Delta I_3$ | | | | −0.25%/V | 1.4%/V | −0.4%/V |
| $\Delta I_{cc}$ | 21 μA | 21 μA | 21 μA | 55 μA | 32 μA | 66 μA |
| $V_{ccmin}$ | 1.1 V | 1.1 V | 1.6 V | 1.1 V | 1.1 V | 1.1 V |

Figure 1:
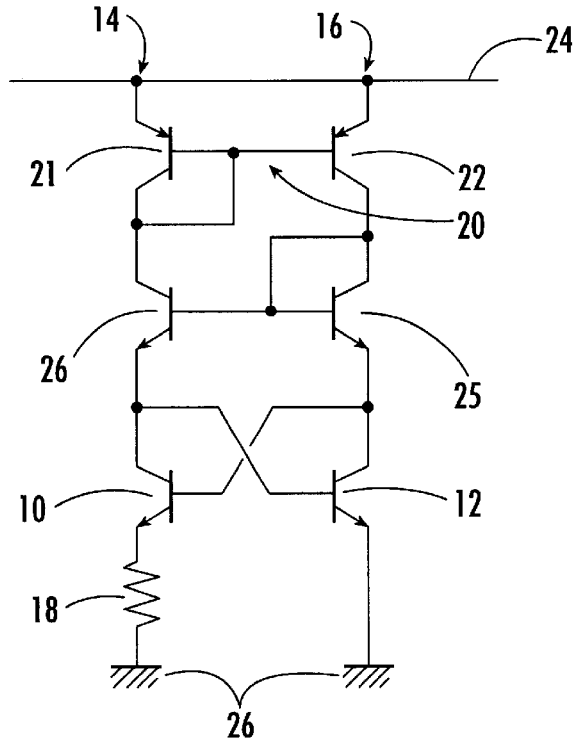
FIG. 1. (PRIOR ART)
FIG. 1 (previously described) is a schematic circuit diagram of a first current source according to the prior art.
Figure 2:
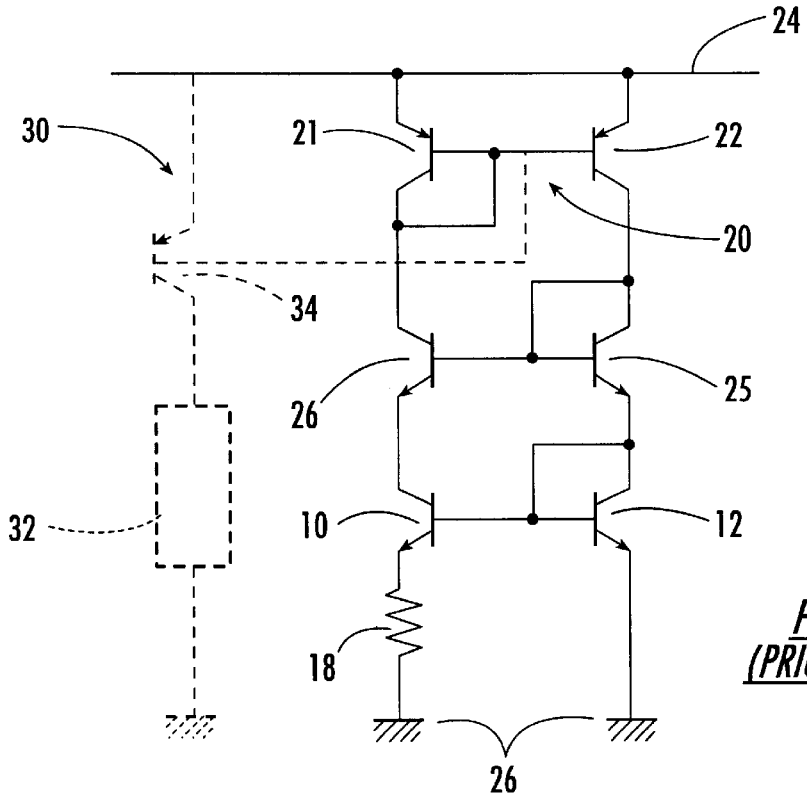
FIG. 2. (PRIOR ART)
FIG. 2 (previously described) is a schematic circuit diagram of a second current source according to the prior art.
Figure 3:
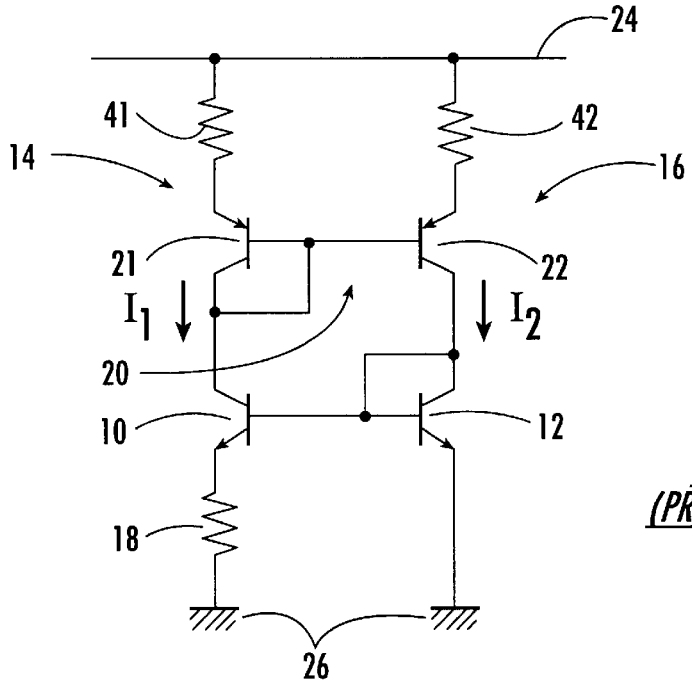
FIG. 3. (PRIOR ART)
FIG. 3 (previously described) is a schematic circuit diagram of a third current source according to the prior art.

It may be seen in Table 1 that the current variations in the source branches according to the invention (FIG. 4) are almost always smaller than those of the emitter degeneration source (FIG. 3). The variation is particularly small in the master branch. Only a very large source emitter degeneration of FIG. 3 makes it possible to obtain high current insensitivity to the supply voltage. However, this is at the cost of a higher value of the minimum supply voltage (1.6 Volts instead of 1.1 Volts).

That which is claimed is:

1. A current source comprising:

a master branch comprising a branch current fixing resistor;

at least one slave branch;

a current mirror comprising a first mirror transistor connected to said master branch, a second mirror transistor connected to said at least one slave branch, and a degeneration resistor connected to said at least one slave branch, said first and second mirror transistors connecting said master branch and said at least one slave branch;

a first injection circuit for injecting a current proportional to the master branch current in the branch current fixing resistor; and a second injection circuit for injecting a current proportional to a current of said at least one slave branch in said degeneration resistor.

2. The current source according to claim 1 wherein said first injection circuit comprises a first injection transistor connected to said branch current fixing resistor and forming a current mirror with said first mirror transistor.

3. The current source according to claim 2 wherein said first injection transistor forms a weighted current mirror with said first mirror transistor.

4. The current source according to claim 2 wherein said first injection transistor has an emitter surface greater than an emitter surface of said first mirror transistor.

5. The current source according to claim 1 wherein said master branch comprises a degeneration resistor connected to said first mirror transistor.

6. The current source according to claim 1 wherein said at least one slave branch comprises a source transistor connected in series with said second mirror transistor; and wherein said second injection circuit comprises a second injection transistor connected to said degeneration resistor and forming a current mirror with said source transistor.

7. The current source according to claim 6 wherein said second injection transistor has an emitter surface greater than an emitter surface of said source transistor.

8. A current source comprising:

a master branch comprising a branch current fixing resistor;

at least one slave branch;

a current mirror comprising a first mirror transistor connected to said master branch and a second mirror transistor connected to said at least one slave branch, said first and second mirror transistors connecting said master branch and said at least one slave branch; and an injection circuit for injecting a current proportional to the master branch current in the branch current fixing resistor.

9. The current source according to claim 8 wherein said injection circuit comprises an injection transistor connected to said branch current fixing resistor and forming a current mirror with said first mirror transistor.

10. The current source according to claim 9 wherein said injection transistor forms a weighted current mirror with said first mirror transistor.

11. The current source according to claim 9 wherein said injection transistor has an emitter surface greater than an emitter surface of said first mirror transistor.

12. The current source according to claim 8 wherein said master branch comprises a degeneration resistor connected to said first mirror transistor.

13. A current source comprising:

a master branch comprising a branch current fixing resistor;

at least one slave branch;

a current mirror comprising a first mirror transistor connected to said master branch, a second mirror transistor connected to said at least one slave branch, and a degeneration resistor connected to said at least one slave branch, said first and second mirror transistors connecting said master branch and said at least one slave branch; and an injection circuit for injecting a current proportional to a current of said at least one slave branch in said degeneration resistor.

14. The current source according to claim 13 wherein said at least one slave branch comprises a source transistor connected in series with said second mirror transistor; and wherein said injection circuit comprises an injection transistor connected to said degeneration resistor and forming a current mirror with said source transistor.

15. The current source according to claim 14 wherein said injection transistor has an emitter surface greater than an emitter surface of said source transistor.

16. An integrated circuit comprising:

a current source and at least one device connected thereto, said current source comprising a master branch comprising a branch current fixing resistor, at least one slave branch, a current mirror comprising a first mirror transistor connected to said master branch, a second mirror transistor connected to said at least one slave branch, and a degeneration resistor connected to said at least one slave branch, said first and second mirror transistors connecting said master branch and said at least one slave branch, a first injection circuit for injecting a current proportional to the master branch current in the branch current fixing resistor, and a second injection circuit for injecting a current proportional to a current of said at least one slave branch in said degeneration resistor.

17. The integrated circuit according to claim 16 wherein said first injection circuit comprises a first injection transistor connected to said branch current fixing resistor and forming a current mirror with said first mirror transistor.

18. The integrated circuit according to claim 17 wherein said first injection transistor forms a weighted current mirror with said first mirror transistor.

19. The integrated circuit according to claim 17 wherein said first injection transistor has an emitter surface greater than an emitter surface of said first mirror transistor.

20. The integrated circuit according to claim 16 wherein said master branch comprises a degeneration resistor connected to said first mirror transistor.

21. The integrated circuit according to claim 16 wherein said at least one slave branch comprises a source transistor connected in series with said second mirror transistor; and wherein said second injection circuit comprises a second injection transistor connected to said degeneration resistor and forming a current mirror with said source transistor.

22. The integrated circuit according to claim 21 wherein said second injection transistor has an emitter surface greater than an emitter surface of said source transistor.

23. A method for using a current source comprising a master branch comprising a branch current fixing resistor, at least one slave branch, a current mirror comprising a first mirror transistor connected to the master branch and a second mirror transistor connected to the at least one slave branch, the first and second mirror transistors connecting the master branch and the at least one slave branch, the method comprising:

injecting a current proportional to the master branch current in the branch current fixing resistor using an injection circuit.

24. The method according to claim 23 wherein the injection circuit comprises an injection transistor connected to the branch current fixing resistor and forming a current mirror with the first mirror transistor.

25. The method according to claim 24 wherein the injection transistor forms a weighted current mirror with the first mirror transistor.

26. The method according to claim 24 wherein the injection transistor has an emitter surface greater than an emitter surface of the first mirror transistor.

27. The method according to claim 23 wherein the master branch comprises a degeneration resistor connected to the first mirror transistor.

28. A method for using a current source comprising a master branch comprising a branch current fixing resistor, at least one slave branch, a current mirror comprising a first mirror transistor connected to the master branch and a second mirror transistor connected to the at least one slave branch, and a degeneration resistor connected to the at least one slave branch, the first and second mirror transistors connecting the master branch and the at least one slave branch, the method comprising:

injecting a current proportional to a current of the at least one slave branch in the degeneration resistor using an injection circuit.

29. The method according to claim 28 wherein the at least one slave branch comprises a source transistor connected in series with the second mirror transistor; and wherein the injection circuit comprises an injection transistor connected to the degeneration resistor and forming a current mirror with the source transistor.

30. The method according to claim 29 wherein the injection transistor has an emitter surface greater than an emitter surface of the source transistor.

* * * * *

UNITED STATES PATENT AND TRADEMARK OFFICE

CERTIFICATE OF CORRECTION

PATENT NO. : 6,465,998 B2
DATED : October 15, 2002
INVENTOR(S) : Phillipe Sirito-Olivier It is certified that error appears in the above-identified patent and that said Letters Patent is hereby corrected as shown below:

Column 2,
Lines 20, 24 and 47, delete "$V_{comin}$" insert -- $V_{ccmin}$ --

Column 3,
Line 6, delete "$V_{comin}$" insert -- $V_{ccmin}$ --

Column 6,
Line 49, delete "Kω" insert -- KΩ --
Line 50, delete "$R_2$=$R_3$=1.4 Kω and $R_1$=5.5Kω" insert -- $R_2$=$R_3$=1.4 KΩ and R1=5.5KΩ --
Line 52, delete "Kω and $R_1$=5.5Kω" insert -- KΩ and $R_1$=5.5KΩ --
Line 55, "$R_2$=$R_3$=1.4 Kω" insert -- $R_2$=$R_3$=1.4 KΩ --
Line 57, delete "1.4Kω" insert -- 1.4 KΩ --

Signed and Sealed this

Third Day of June, 2003

JAMES E. ROGAN
*Director of the United States Patent and Trademark Office*